US006835922B1

(12) United States Patent
Shimoi et al.

(10) Patent No.: US 6,835,922 B1
(45) Date of Patent: Dec. 28, 2004

(54) PHOTOMULTIPLIER TUBE AND PRODUCTION METHOD THEREFOR

(75) Inventors: Hideki Shimoi, Hamamatsu (JP); Yuji Masuda, Hamamatsu (JP); Hiroyuki Kyushima, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 10/275,683

(22) PCT Filed: May 8, 2000

(86) PCT No.: PCT/JP00/02926

§ 371 (c)(1),
(2), (4) Date: Nov. 8, 2002

(87) PCT Pub. No.: WO01/86689

PCT Pub. Date: Nov. 15, 2001

(51) Int. Cl.[7] ..... H01J 40/14

(52) U.S. Cl. ..... 250/214 VT; 250/207; 313/103 CM

(58) Field of Search ..... 250/214 VT, 207; 313/103 CM, 105 CM

(56) References Cited

U.S. PATENT DOCUMENTS 5,504,386 A * 4/1996 Kyushima et al. ..... 313/103 R 5,864,207 A * 1/1999 Kume et al. ..... 313/533

FOREIGN PATENT DOCUMENTS

| | | |
|---|---|---|
| JP | A 61-83985 | 4/1986 |
| JP | A 5-290793 | 11/1993 |
| JP | A 11-345587 | 12/1999 |
| JP | A 2000-149862 | 5/2000 |

* cited by examiner

*Primary Examiner*—Stephone B. Allen
(74) *Attorney, Agent, or Firm*—Oliff & Berridge, PLC

(57) ABSTRACT

A hermetically sealed vessel for a photomultiplier tube made of a side tube (2), a faceplate and a stem plate. The side tube is made by assembling a plurality of plates (80) with a curled end. An end face (81*a*) on a corner (81) at an open end of the side tube facing the faceplate is at a higher level than the faces other than the end face (81*a*). When being heated, the end face (81*a*) is deeply embedded into the faceplate, which enhances the joint between the side tube and the faceplate. Because the whole open end of the side tube (2) facing the faceplate is embedded into the faceplate, the joint between the side tube (2) and the faceplate is ensured, thereby improving throughput for the joining operation. The side tube is readily integral with the faceplate, which contributes to enhanced hermeticity of the sealed vessel.

18 Claims, 10 Drawing Sheets

PHOTOMULTIPLIER TUBE AND PRODUCTION METHOD THEREFOR

TECHNICAL FIELD

The present invention relates to a photomultiplier tube for detecting weak light incident on a faceplate by multiplying electrons emitted on the faceplate, and a method for manufacturing the photomultiplier tube.

BACKGROUND ART

Japanese patent Kokai publication No. Hei 5-290793 discloses a conventional photomultiplier tube wherein a hermetically sealed vessel accommodates an electron multiplier. Referring to FIG. 18, a flange 101 is formed over the entire upper end of a metal side tube 100. A lower end face 111*a* of the flange 101 contacts an upper face 102*a* of a faceplate 102. The side tube 100 and an upper face 102*a* of the faceplate 102 are then crimped and welded. Therefore, the flange 101 ensured that the vessel is hermetically sealed.

Heating the side tube 100 is required to weld the side tube to the faceplate. If the side tube 100 has a rectangular section, the amount of heat generated on each of the four corners in the flange 101 is greater than that of the portions other than the corners of the flange 101. As a result, when the flange 101 is fixed to the faceplate 102, a problem may arise that the fixed conditions on the corners are different from those of the portions other than the corners. Accordingly, the problem may affect throughput of manufacturing photomultiplier tubes. Additionally, deformation of the flanges due to heat may result in instability of the hermetic property of the vessel.

DISCLOSURE OF INVENTION

An object of the present invention is to provide a photomultiplier tube and a manufacturing method thereof in which the method provides improved throughput, and integration of the side tube and the faceplate are ensured to obtain enhanced hermetic sealing of the vessel.

The present invention features a photomultiplier tube which has a photocathode for emitting electrons in response to light incident on a faceplate; an electron multiplier in an hermetically sealed vessel for multiplying electrons emitted from the photocathode; and an anode for generating an output signal based on electrons multiplied by the electron multiplier. The hermetically sealed vessel includes: a stem plate having stem pins for fixing the electron multiplier and the anode thereon; a metal side tube enclosing the electron multiplier and the anode, and having one open end to which the stem plate is fixed; and the faceplate fixed to another open end of the side tube, the faceplate being made of glass. The side tube has a polygonal shape defined by a plurality of plates, each of the plurality of plates having a rolled-up upper end, and the side tube is fused to the faceplate in such a manner that the upper end of each side is embedded in a photocathode side of the faceplate.

In the above photomultiplier tube, the rolled-up edges of the plurality of plates are joined so that the joined plates have a polygonal shape. Each corner, that is, the joint of the plates, is raised more than the other portions. As a result, the upper end of the side tube is more deeply embedded in the faceplate, which contributes to an improved joint condition between the side tube and the faceplate. In addition, the fusion between the side tube and the faceplate is ensured, so that the hermetic seal at the joint portion between the side tube and the faceplate is improved. The throughput of manufacturing the photomultiplier tube is improved.

In the photomultiplier according to present invention, the side tube preferably has an edge portion on the upper end, the edge portion being embedded in a photocathode side of the faceplate. The edge portion provided in the side tube is embedded perpendicularly to the glass faceplate, which contributes to conformability between the side tube and the faceplate and reliability of tight hermetic seal. The edge portion extends upright from the side tube rather than laterally from the side tube like a flange. When the edge portion is embedded as closely as possible to the side face of the faceplate, the effective surface area of the faceplate is increased to nearly 100%. The dead area of the faceplate can be decreased to as nearly 0 as possible.

A tip end of the edge portion of the photemultiplier tube preferably extends straight. This structure enables the edge portion of the side tube to pierce the faceplate. Furthermore, the edge portion is on a line extending from the side tube, which promotes enlargement of the effective sensitive area of the faceplate.

According to present invention, a tip end of the edge portion of the photomultiplier tube may be curved in either one of an interior and an exterior of the side tube. This structure increases a surface area of the edge portion embedded in the faceplate, contributing to improved hermetic seal of the joint between the side tube and the faceplate.

The edge portion of the photomultiplier tube preferably has a knife-edged tip end. This structure enables the edge portion of the side tube to pierce into the faceplate. Therefore, assembly operation and reliability are improved when the glass faceplate is fused to the side tube.

In the photomultiplier tube according to the present invention, it is preferable that an inner side wall at the lower end of the side tube is in contact with an end face of the metal stem plate, then the metal side tube and the metal stem plate are welded together. If this structure is adopted, the side tube and the faceplate are fused together, with an inner side wall at the lower end of the side tube being in contact with an edge face of the stem plate. Therefore, a projection such as a flange is eliminated at the lower end of the photomultiplier tube. Accordingly, it is possible to reduce the external dimensions of the photomultiplier tube, though the above structure of the photomultiplier tube and the side tube may be improper for resistance-welding. When several photomultiplier tubes are arranged, it is possible to place the side tubes closely to each other.

The present invention provides a photomultiplier tube having: a photocathode for emitting electrons in response to light incident on a faceplate; an electron multiplier in an hermetically sealed vessel for multiplying electrons emitted from the photocathode; and an anode for generating an output signal based on electrons multiplied by the electron multiplier. The hermetically sealed vessel includes: a stem plate having stem pins for fixing the electron multiplier and the anode thereon; a metal side tube having open ends and enclosing the electron multiplier and the anode, the stem plate being fixed to one of the open ends; and the faceplate fused to the other open end of the side tube, the faceplate being made of glass. The side tube has a cylinder having a polygonal section, the side tube having a plurality of corners, an end face on each of the plurality of corners protrudes beyond an end face of the side tube other than the end faces on the plurality of corners, the faceplate is fused to the other open end so that the other open end is embedded in the photocathode side of the faceplate.

The end face corresponding to the corner at the open end of the side tube facing the faceplate is at a higher level than that of the end face other than the corner. At first, the faceplate is supported by the protruding end face on the corner. Then, melting of the faceplate is started from the supporting position, so that the positional relationship between the side tube and the faceplate is ensured at an early stage of the fusion. Accordingly, the shape of the side tube is readily maintained even during heating.

The present invention features a method for manufacturing a photomultiplier tube having: a photocathode for emitting electrons in response to light incident on a faceplate; an electron multiplier in an hermetically sealed vessel for multiplying electrons emitted from the photocathode; and an anode for generating an output signal based on electrons multiplied by the electron multiplier. The photomultiplier tube includes a side tube having a polygonal section with a plurality of plates, each of the plurality of plates having a curled upper end. The method includes the steps of: contacting the upper end on the corner of the side tube to a back surface of the faceplate; and heating the side tube to fuse the upper end of the side tube with the faceplate.

According to the above method, the side tube has a polygonal shape, and is made of a plurality of plates, each of the plates having a curled upper end. When the side tube and the faceplate are assembled, the upper end on a corner of the side tube is first brought into contact with the faceplate. When the side tube is heated, the faceplate starts melting from the corner due to a larger heating value. The melting of the faceplate proceeds toward the center of the plate. Accordingly, the upper end of the corner is fused to the faceplate at first during the early stage of fusing between the faceplate and the heated side tube. The shape of the side tube is maintained while the side tube is heated. The fusing time at the upper end of the corner is longer than the other parts of the upper end. Therefore, the conformability to the glass at the upper end of the corner is improved, thereby avoiding any cracks from occurring at the upper end of the corner. In addition, throughput of manufacturing a photomultiplier tube is improved. The side tube is reliably integral with the faceplate and hermetic sealing of the vessel is enhanced.

The method according to the present invention, an edge portion is provided on the upper end of the side tube, the edge portion is to be embedded into the faceplate. When the above method is adopted, the end of the side tube is easy to be embedded in to the faceplate. And the time required to assemble can be shortened.

According to a method of the present invention, the lower end of the side tube is placed on a rotating platform to force the faceplate onto the side tube. Because the side tube is placed on the rotating platform, un-uniform heating over the side tube during the fusion is reduced. As a result, conformability between the side tube and the faceplate is improved, because the faceplate is pressed to the side tube.

The present invention features a method for manufacturing a photomultiplier tube including: a photocathode for emitting electrons in response to light incident on a faceplate; an electron multiplier in an hermetically sealed vessel for multiplying electrons emitted from the photocathode; and an anode for generating an output signal based on electrons multiplied by the electron multiplier. A side tube has a polygonal hollow section and an upper open end and a lower open end. The method includes the steps of: orientating a side tube upright in the manner that an end face on a corner of the upper open end protrudes beyond the end face on the upper end other than the corner; contacting a surface on a photocathode side of the faceplate with an open end face of the upper open end; and heating the side tube to melt a part of the faceplate and fuse the faceplate to the upper end of the side tube while the upper open end of the side tube is embedded into the faceplate.

According to the above method, the positional relation between the side tube and the faceplate is maintained during an early stage of the heating and fusing. The side tube is fused to the faceplate so that the whole open end of the side tube is embedded into the faceplate. Thus, the fusion of the side tube and the faceplate is readily ensured, thereby improving the hermetic seal of the joint between the side tube and the faceplate. In addition, throughput of manufacturing a photomultiplier tube can be improved.

BEST MODE FOR CARRYING OUT THE INVENTION

Figure 1:
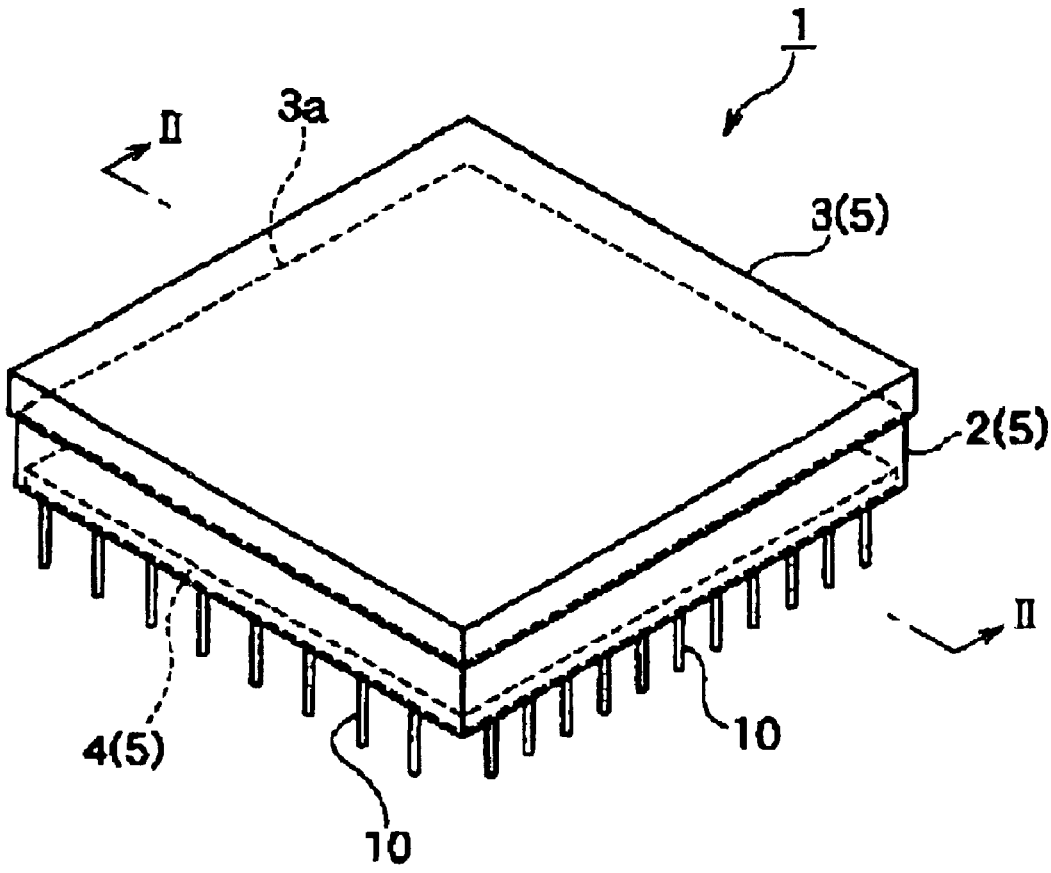
FIG. 1 is a perspective view showing one embodiment of a photomultiplier tube according to the present invention.

The following description will be made for explaining preferred embodiments of a photomultiplier tube according to the present invention, referring to the drawings.

Figure 2:
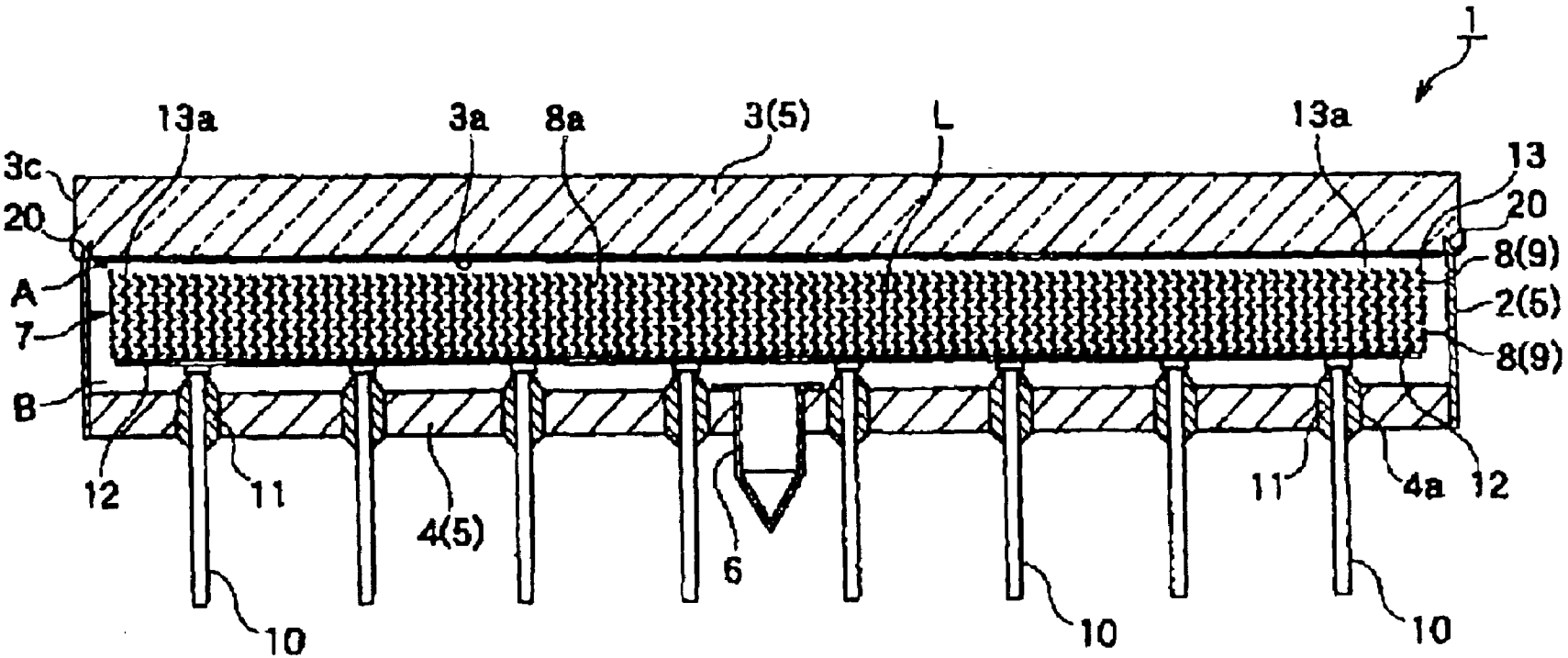
FIG. 2 is a sectional view taken along the line II—II of FIG. 1.

Referring to FIGS. 1 and 2, a photomultiplier tube 1 has a side tube 2 having substantially rectangular section and made from metal such a Kovar metal and stainless steel. The photomultiplier tube 1 also has a glass faceplate 3 fused to one open end A of the side tube 2. A photocathode 3*a* for converting light into an electron is provided on an inner surface (back surface) of the faceplate 3. The photocathode 3*a* is formed by reacting alkali metal vapor with antimony deposited on the faceplate 3. The photomultiplier tube 1 has a stem plate 4 welded to the other open end B of the side tube 2. The stem plate 4 is made from metal such as Kovar metal and stainless steel. The side tube 2, the faceplate 3, and the stern plate 4 constitute a hermetically sealed vessel 5 having a low height of substantially 10 mm.

A metal evacuating tube 6 is provided upright in the center of the stem plate. The metal evacuating tube 6 is used for evacuating the vessel 5 with a vacuum pump (not shown) after assembly of the photomultiplier tube 1 is finished. The metal evacuating tube 6 is also used to introduce alkali metal vapor into the vessel 5 during formation of the photocathode 3*a*.

The stem plate 4 has a plurality of metal stem pins 10 made from Kovar which pass through the stem plate 4. The stem plate 4 has pin holes 4*a* for the stem pins 10 to pass therethrough. The pin hole 4*a* is filled with tablet 11 made from Kovar glass as a hermetic seal. Each stem pin 10 is secured to the stem plate 4 by the tablet 11.

The vessel 5 accommodates an electron multiplier 7. The electron multiplier 7 is supported in the vessel 5 by the stem pins 10. The electron multiplier 7 has a stacked structure of a block shape. Ten (10) stages of flat dynodes 8 are stacked into an electron multiplier section 9. Each dynode 8 is electrically connected to a tip of the stem pin 10. It should be noted that the stem pins 10 are classified into two groups: one group to be connected to the dynodes 8; the other group to be connected to an anode 12 described later.

The electron multiplier 7 has anodes 12 positioned under the electron multiplying section 9. The anodes 12 are secured to upper ends of the anode pins. A flat focusing electrode 13 is disposed between the photocathode 3*a* and the electron multiplying section 9 over the top stage of the electron multiplier 7. The focusing electrode plate 13 has a plurality of slit-shaped openings 13*a*. The openings 13*a* are arranged parallel to each other in one direction. Each dynode 8 in the electron multiplier section 9 has slit-shaped electron multiplying holes 8*a*. The electron multiplying holes 8*a* are linear in a direction and arranged parallel to each other.

Electron multiplying paths L are provided by arranging the electron multiplying holes 8*a* of each dynode 8 in a perpendicular direction to the faceplate 3. A plurality of channels are formed in the electron multiplier 7 by aligning the electron multiplying path L with the corresponding opening 13*a* of the focusing electrode plate 13. The anodes 12 in the electron multiplier 7 are configured in an 8×8 arrangement, so that each anode 12 is associated with a predetermined number of channels. Because the anode 12 is connected to the corresponding stem pin 10, output signals for each channel can be retrieved through each anode pin 10B.

As described above, the electron multiplier 7 has a plurality of linear channels. A predetermined voltage is applied across the electron multiplying section 9 and the anodes 12 through the stem pin 10 connected to a bleeder circuit (not shown). The photocathode 3*a* and the focusing electrode plate 13 are set to be at the same potential. The potential of each dynode 8 increases from the top stage of dynode toward the anodes 12. Therefore, incident light on the faceplate 3 is converted into electrons at the photocathode 3*a*. The electrons are guided into a certain channel by the electron lens effect generated by the focusing electrode plate 13 and the first stage of dynode 8 on the top of the electron multiplier 7. The electrons guided into the channel are multiplied through each stage of dynodes 8 while passing through the electron multiplying paths L. The electrons strike the anodes 12 to generate an individual output signal for the corresponding channel.

Figure 3:
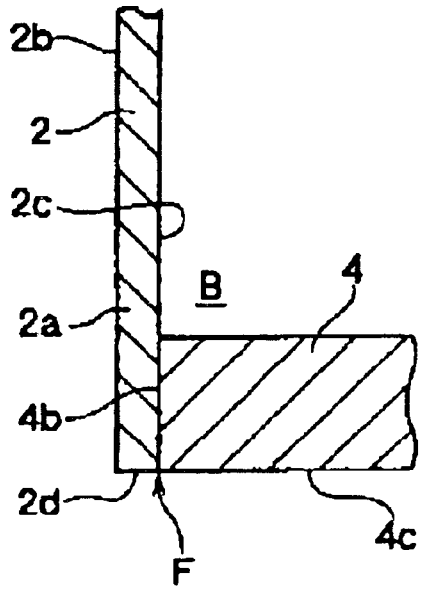
FIG. 3 is an enlarged sectional view showing a joint of a side tube and a stem plate of the photomultiplier tube according to a first embodiment of the present invention.

Referring to FIG. 3, when the metal stem plate 4 and the metal side tube 2 are hermetically welded, an outer end face 4*b* of the stem plate 4 is fit with an inner side wall 2*c* at the open end B of the side tube 2. Next, the stem plate 4 is inserted through the open end B to the side tube 2, so that the inner side wall 2*c* at a lower end 2*a* of the side tube 2 is in contact with the outer side face 4*b* of the stem plate 4. Additionally, this structure avoids formation of any lateral protrusion such as a flange at the lower end of the photomultiplier tube 1. In this state, a junction F between the side tube 2 and the stem plate 4 is laser-welded by irradiating a laser beam onto the junction F from a point directly below and external to the junction F or in a direction toward the junction F.

By eliminating the flange-like overhang on the lower end of the photomultiplier tube 1, it is possible to reduce the external dimensions of the photomultiplier tube 1, though the above structure of the photomultiplier tube 1 and the side tube 2 may be improper for resistance-welding. Further, when several photomultiplier tubes 1 are arranged, it is possible to minimize dead space between neighboring photomultiplier tubes 1 as much as possible, thereby placing the neighboring side tube 2 of photomultiplier tubes 1 closely to each other. Laser welding is employed to bond the stem plate 4 and side tube 2 together in order to achieve a thin structure of the photomultiplier tube 1 and to enable high-density arrangements of the photomultiplier tube 1.

The above laser welding is one example for fusing the stem plate 4 and the side tube 2. When the side tube 2 and the stem plate 4 are welded together using the laser welding, it is unnecessary to apply pressure across the junction F between the side tube 2 and stem plate 4 in contrast to resistance welding. Hence, no residual stress is induced at the junction F, thereby avoiding cracks from occurring at this junction during usage. The usage of the laser welding greatly improves the durability and hermetic seal of the photomultiplier tube 1. Laser welding and electron beam welding prevent generation of heat at the junction F, compared to the resistance welding. Hence, when the photomultiplier tube 1 is assembled, there is very little effect of heat on the components in the vessel 5.

Figure 4:
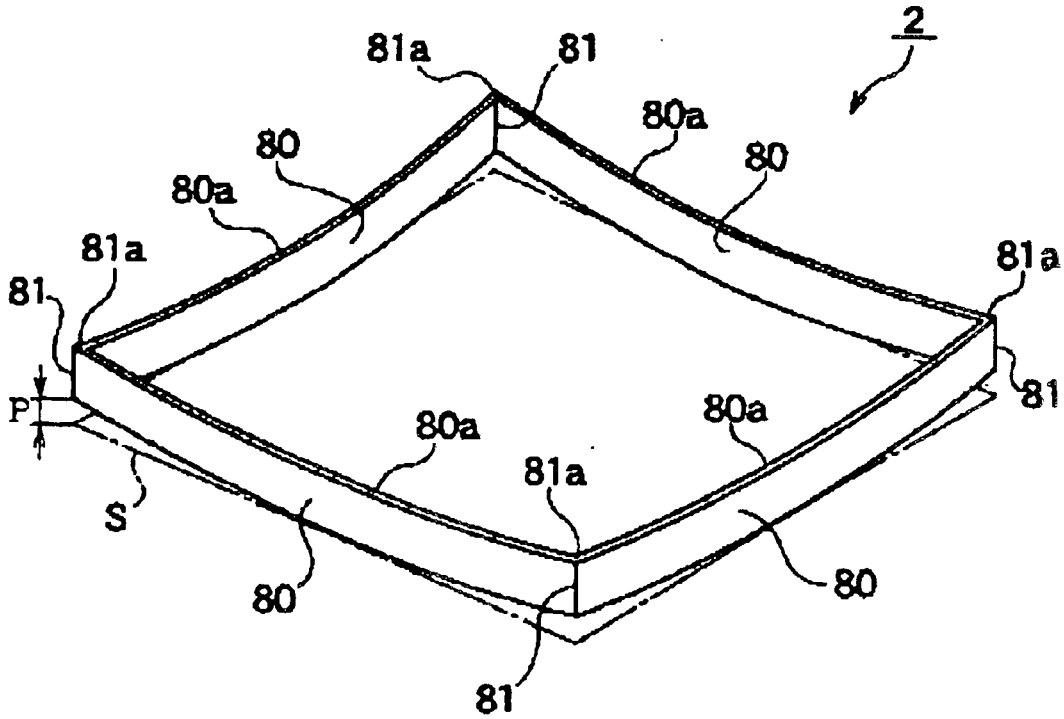
FIG. 4 is a perspective view showing a side tube for use in a photomultiplier tube according to an embodiment of the present invention.

Referring to FIG. 4, the side tube 2 having a height of 7 mm has a rectangular shape, and is defined by four substantially rectangular flat plates 80 of Kovar metal or stainless steel, each plate having a thickness of 0.25 mm. In FIG. 4, an open end A of the side tube 2 is orientated upwardly, the open end B downwardly. Each plate 80 is a flat member having a pair of vertical sides and a pair of horizontal sides, all of vertical and horizontal sides being in one plane. The horizontal sides are parallel to each other and curved. The neighboring vertical sides of the plates are connected together to provide a corner 81. Due to the curved-shape of the horizontal sides, upper ends 81*a* of the corners 81 facing the faceplate 3 is raised beyond the ends 80*a* of the horizontal sides other than the corners. In particular, if there is a virtual plane S on the open end B side of the side tube 2, the corner 81 constituting a joint of the vertical sides of the plates 80 is raised vertically from the virtual plane S by a height P such as 0.1 mm. As a result, the upper end 81*a* is at a higher level than a center of the upper end 80*a* of each plate 80. In order to obtain as large effective sensitive area of the faceplate 3 as possible, the corner 81 is subject to an edging process to achieve a small R-shape.

As described above, the side tube 2 having the raised upper end 81*a* of the corner can be produced by laser-welding the four plates 40 described above together, or stamping a single flat plate such as Kovar metal. If the side tube 2 has a thin thickness such as 0.25 mm, stamping a flat plate into an arched-shape is easy. Therefore, additional process to warp plate 80 is unnecessary.

Figure 5:
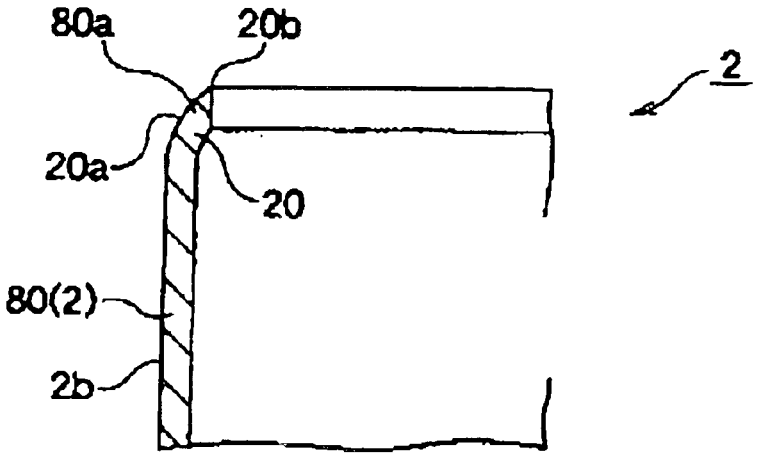
FIG. 5 is an enlarged sectional view showing an upper end of the side tube shown in FIG. 4.

The faceplate 3 made from glass is fused to the open end A of the side tube 2 which has the raised upper end 81*a*. Referring to FIG. 5, the side tube 2 has an edge portion 20 provided at a tip end (upper end) 80*a* on the faceplate 3 side of the plate 80. The edge portion 20 is provided over the entire upper end of the side tube 2. The edge portion 20 curves toward an interior of the side tube 2 through the R-shaped portion 20*a* on an outer side wall 2*b* of the side tube 2. A tip end 20*b* of the edge portion 20 has a knife-edged shape. When a part of the faceplate 3 is melted by high frequency heating, the edge portion 20 is embedded into the melted faceplate 3. Accordingly, the knife-edged tip end 20*b* enables the upper end of the side tube 2 to penetrate the faceplate 3. When the glass faceplate 3 is intended to be fused to the side tube 2, efficiency and reliability of assembling the faceplate and the side tube is improved.

The next description will be made for explaining a method for manufacturing the photomultiplier tube 1.

Figure 6:
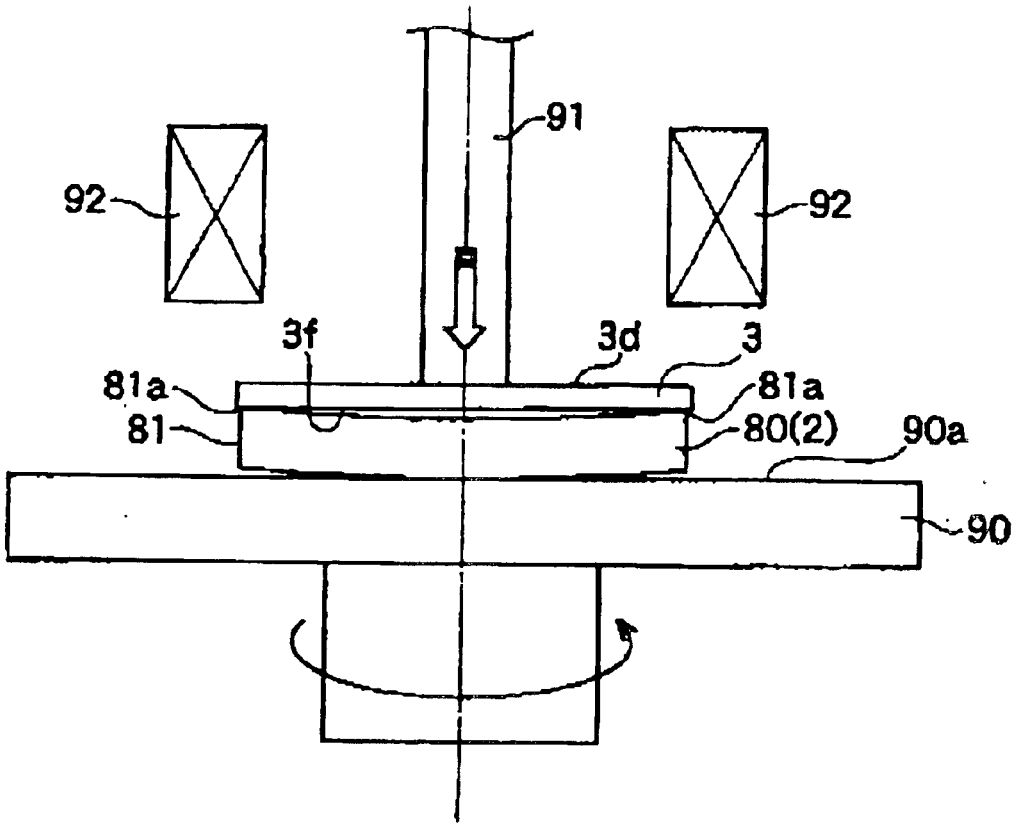
FIG. 6 is a front view showing how to joint the side tube and the faceplate by using the method of the present invention.
Figure 7:
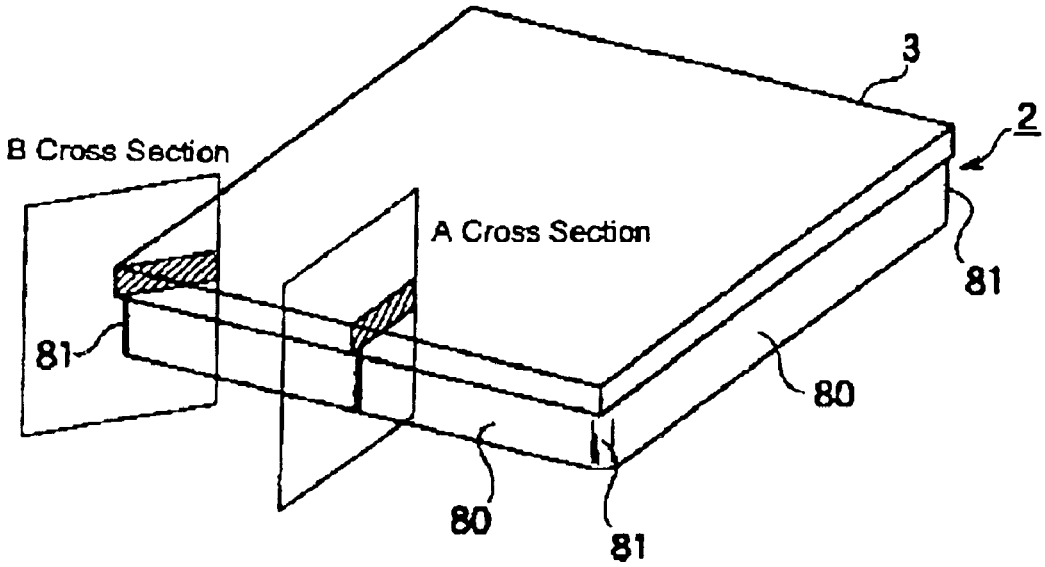
FIG. 7 is a perspective view showing the side tube and the faceplate joined by using the method of the present invention.

Referring to FIG. 6, the side tube 2 is placed on an upper face 90*a* of a ceramic rotating platform 90 which is rotated at a predetermined speed by a driving device such as a motor. At this time, the side tube 2 is placed on the rotator 90 in the manner that the lower end of the corner 81 is suspended from the upper face 90*a* of the rotating platform 90. A back surface 3*f* of the faceplate 3 is then in contact with the side tube 2. The faceplate 3 is supported on four upper ends 8*la* of the corners 81. At this time, the center of the photocathode 3*d* on the faceplate 3 is pressed from the top by a pressing jig 91. Then, a high frequency heater 92 is activated, and the rotating platform 90 is simultaneously rotated in order to avoid uneven welding conditions of the side tube 2 due to variations in heating. Therefore, as shown in FIG. 7, the side tube 2 is readily integral with the faceplate 3.

Figure 8:
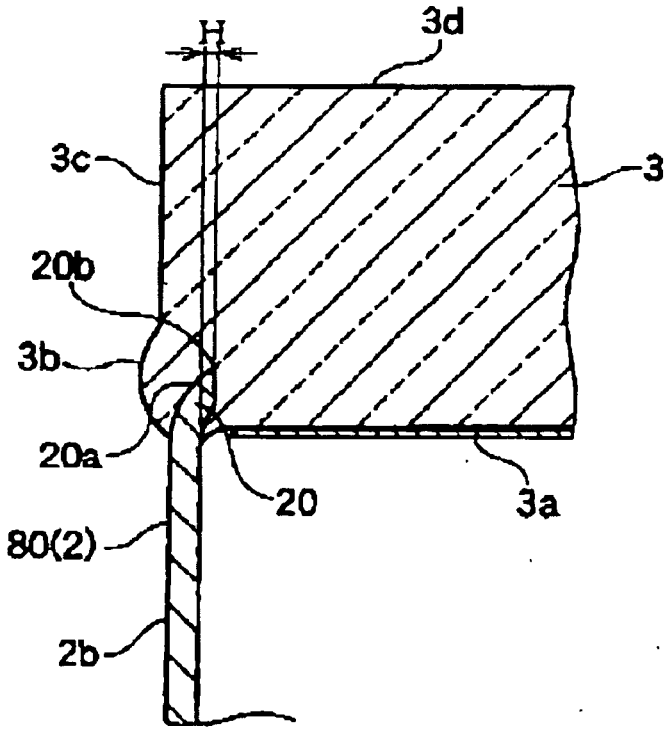
FIG. 8 is an enlarged view showing the A-section of FIG. 7.

At this time, the heated edge portion 20 of the side 25 tube 2 gradually melts the glass faceplate 3, and penetrates the faceplate. As a result, as shown in FIG. 8, the edge portion 20 is embedded into the faceplate 3 while forming an expanding portion 3*b* at the lower end of the faceplate 3, thereby ensuring a tight seal at the juncture between the glass faceplate 3 and side tube 2.

The expanding portion 3*b* is generated on only a part of the faceplate 3 in the vicinity of the edge portion 20. In other words, the generation of the expanding portion 3*b* does not cause whole deformation over the side face 3*c* of the faceplate 3. Accordingly, the generation of the expanding portion 3*b* does not affect the edge shape of the faceplate 3*d*. The flat shape of the faceplate 3 is reliably maintained.

The edge portion 20 extends upward from the side tube 2 in an axial direction of the side tube 2 rather than extends laterally from the side tube 2 like a flange. Accordingly, when the edge portion 20 is embedded as closely as possible to the edge face 3*c* of the faceplate 3, the effective surface area of the faceplate 3 is increased to nearly 100%. The dead area of the faceplate 3 can be decreased to as nearly 0 as possible. Additionally, the edge portion 20 is formed so as to curve toward in interior of the side tube 2. Therefore, a surface area of the portion of the guide portion 20 embedded in the faceplate 3 is increased, so that the contact area of the side tube 2 and the faceplate 3 is increased. This structure contributes to enhanced hermetic seal of the vessel S. The edge portion 20 projects inwardly of the side tube 2 by a small amount H of 0.1 mm.

Figure 9:
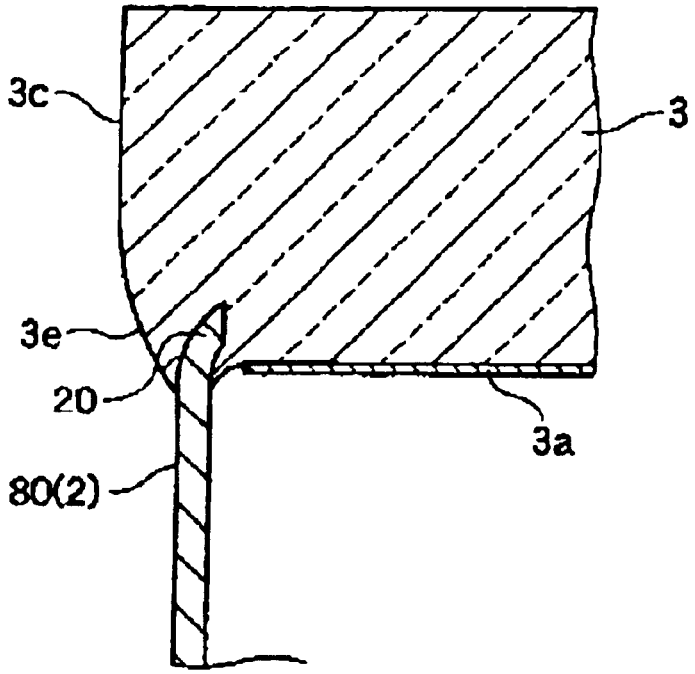
FIG. 9 is an enlarged view showing the A-section of FIG. 7.

During the process for the fusing, an upper end 81*a* on the corner 81 first comes into contact with the faceplate 3. When the side tube 2 is heated, the faceplate 3 starts melting from the corner 81 due to a higher calorific value. The melting then proceeds toward the center of the plate 80. Therefore, in an early stage of the process for melting the faceplate 3 by the side tube 2, the upper end 81*a* of the corner 81 is first fused to the faceplate 3. Accordingly, the rectangular shape of the side tube 2 is readily maintained during the heating. The fusing time on the upper end 81*a* of the corner 81 is longer than the other parts. Therefore, referring to FIG. 9, the side tube 2 becomes conformable with glass on the upper end 81*a* of the corner 81, while a deformation 3*e* is formed at the lower end edge of the faceplate 3. As a result, high hermetic seal at the joint between the faceplate 3 and the side tube 2 is readily achieved. Simultaneously, the occurrence of cracks in the faceplate 3 over the upper end 81*a* of the corner 81 can be avoided.

Figure 10:
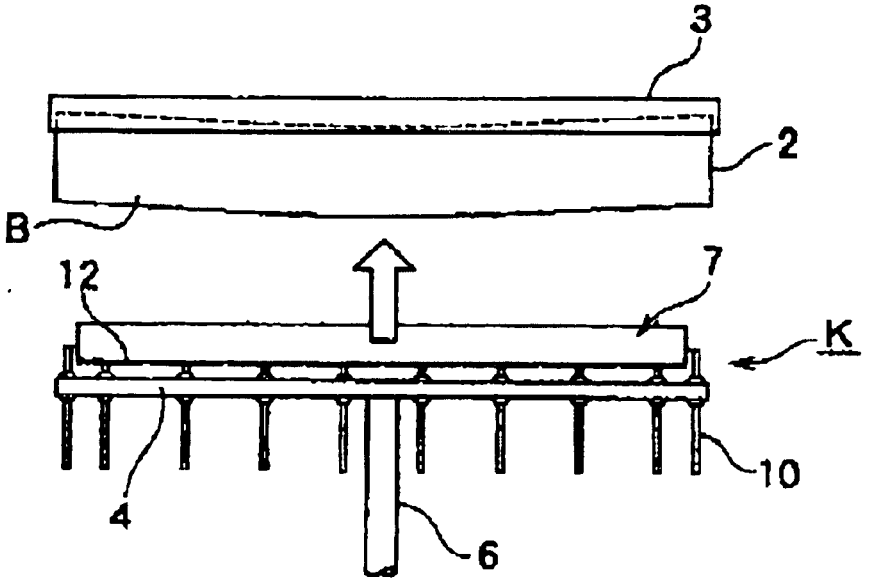
FIG. 10 is a front view showing a method of the present invention for manufacturing a photomultiplier tube in that an assembly of the stem plate, the stem pins, the anode, and the electron multiplier are inserted into the side tube through an open end of the side tube.
Figure 11:
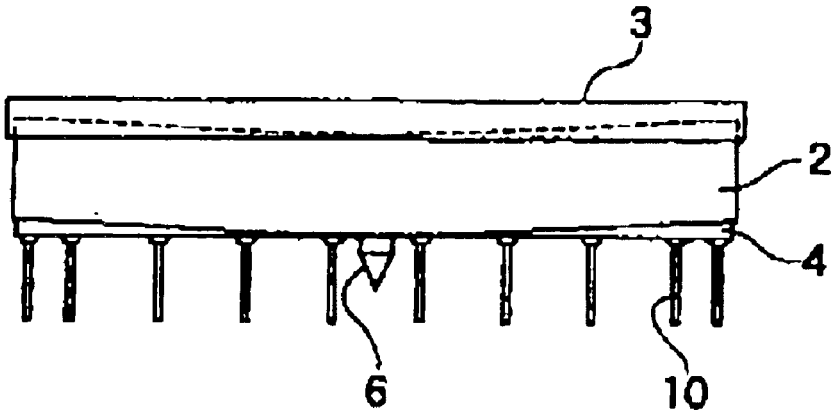
FIG. 11 is a front view showing the assembled photomultiplier tube according to the present invention.
Figure 12:
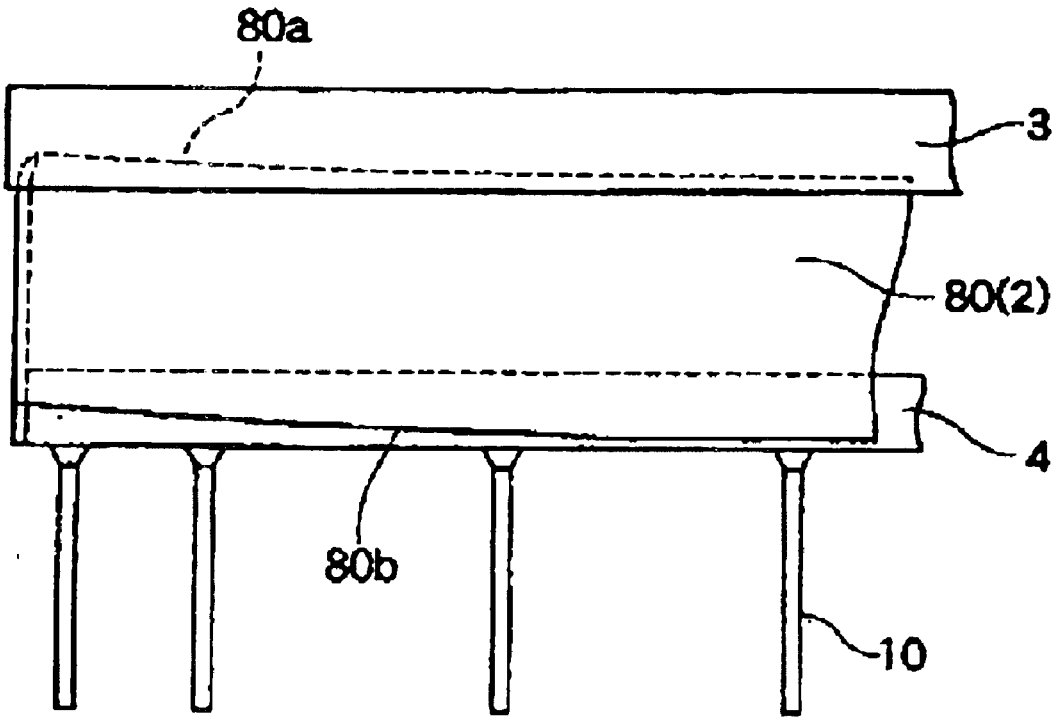
FIG. 12 is an enlarged view showing a main part of FIG. 11.

Referring to FIG. 10, after integrating the faceplate 3 and the side tube 2, an assembly K consisting of the anode 12 and the electron multiplier 7 fixed on the stem plate 4 by using the stem pins 10 is inserted into the side tube 2 through the open end B thereof. Then, as shown in FIG. 11, the stern plate 4 and the side tube 2 are integrated. In this case, a lower end (a lower horizontal side) 80*b* of each plate 80 has an arched shape in the manner that the center of the horizontal side protrudes toward the open end B. In the process to tightly fuse the metal stem plate 4 to the metal side tube 2, the side tube 2 is laser-welded to the stem plate 4 in the manner that the lower end 80*b* of the plate 80 does not protrude under the lower surface of the metal stem plate 4. Such laser-welding can be performed by selecting a thickness of the stem plate 4 dependently on the arched degree of the lower end 80*b* of the plate 80.

After finishing the assembly, the interior of the vessel S is evacuated into a vacuum by a vacuum pump (not shown) through the opened evacuating tube 6 (see FIG. 10). Alkali metal vapor is introduced into the vessel 5 through the evacuating tube 6 to form the photocathode 3*a* on the faceplate 3. The evacuating tube 6 is then closed (see FIG. 11).

Figure 13:
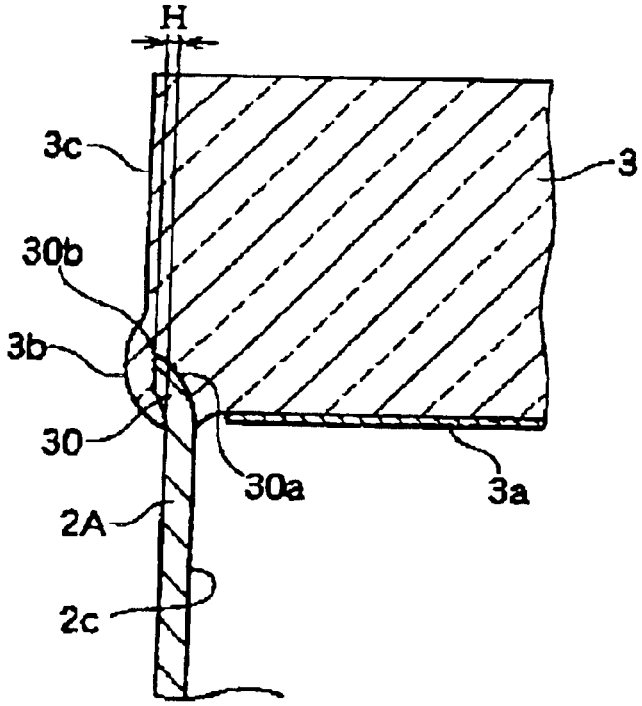
FIG. 13 is an enlarged view showing a first modification of the side tube for use in the photomultiplier tube according to the present invention.

A photomultiplier tube and a manufacturing method therefor are not limited to the embodiments described above, but there are a lot of modifications and applications. For example, FIG. 13 shows a first modification. In this modification, an edge portion 30 is formed on a tip end of the side tube 2A facing the photocathode 3*a*, and melted and embedded into the photocathode 3*a* aide of the faceplate 3 by high frequency heating. The edge portion 30 is also provided over the entire upper end of the side tube 2A, and curves toward an exterior of the side tube 2A through an R-shaped portion 30*a* on an inner side wall 2*c* of the side tube 2A. The tip end 30*b* of the edge portion 30 is sharpened like a knife-edge. Accordingly, it is easy to penetrate the upper end of the side tube 2A into the faceplate 30. As a result, reliability of assembly is enhanced and improved, when the metal side tube 2A is fused to the glass faceplate 3. In this case, the edge portion 30 of the side tube 2A is embedded into the faceplate 3, while forming an expanded portion 3*b* at the lower end of the faceplate 3. Thus, high hermetic seal at the joint of the faceplate 3 and the side tube 2A is readily ensured.

In addition, the edge portion 30 curves toward the exterior of the side tube 2A, a surface area of the edge portion 30 embedded in the faceplate 3 is increased. The contact area between the side tube 2A and the faceplate 3 is also increased, which contributes to the enhanced hermetic seal of the vessel 5. It should be noted that the edge portion 30 projects outwardly of the side tube 2A by a small amount H of 0.1 mm due to stamping.

Figure 14:
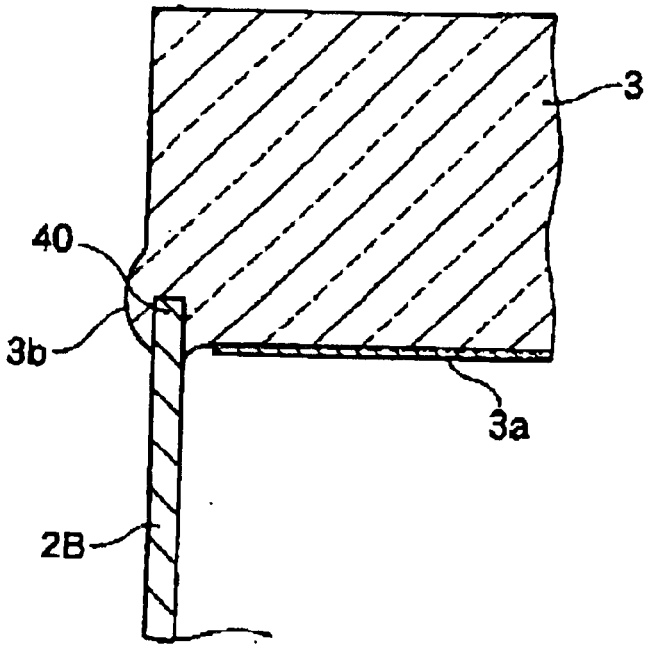
FIG. 14 is an enlarged view showing a second modification of the side tube for use in the photomultiplier tube according to the present invention.

FIG. 14 shows a second modification, in which an edge portion 4D may extend straight along an axial direction of the aide tube 2B. In this case, the edge portion 40 is on a line extending from the side tube 2B. The edge portion 40 has a simple shape in the manner that the aide tube 2B is just cut. The edge portion 40 may have a round tip in order to enhance conformability with glass and increase a surface area of the edge portion 40.

Figure 15:
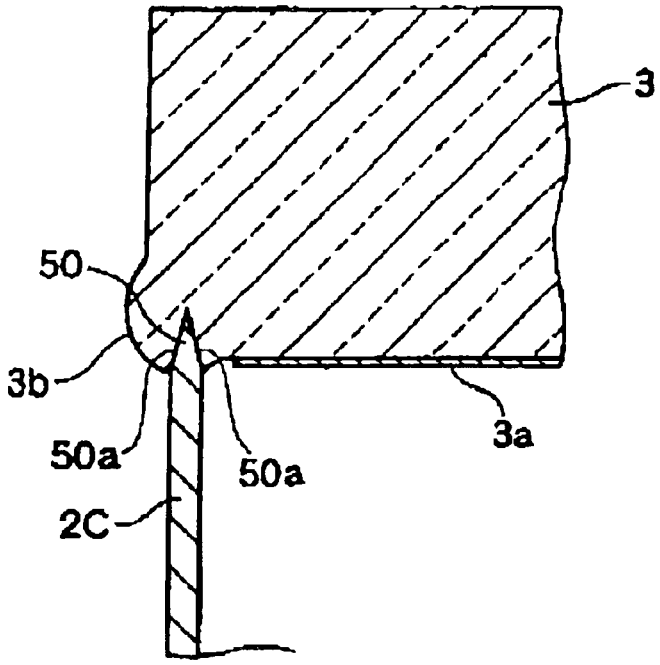
FIG. 15 is an enlarged view showing a third modification of the side tube for use in the photomultiplier tube according to the present invention.

FIG. 15 shows a third modification, in which an edge portion 50 extends straight along an axial direction of the side tube 2C. The edge portion 50 has a double-edged tip end 50*a*. When the side tube 2C and the faceplate 3 are fused together, this shape of the edge portion 50 enables the side tube 2C to be inserted into the faceplate 3 easily.

Figure 16:
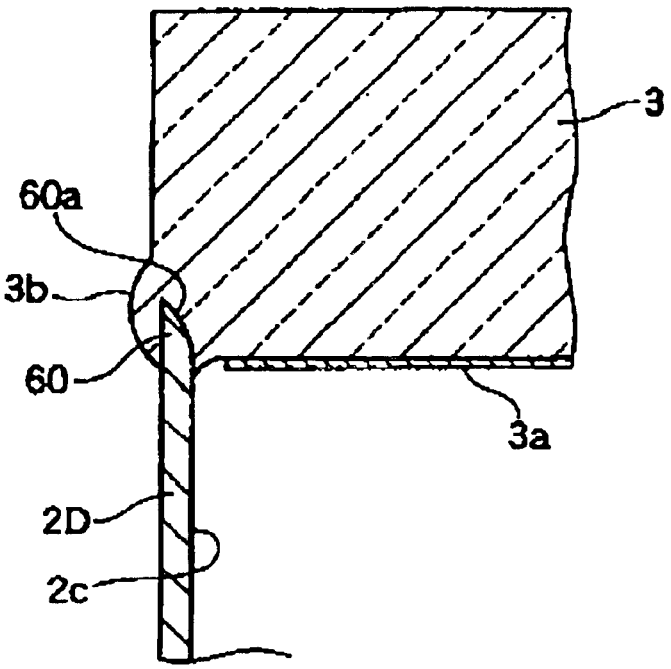
FIG. 16 is an enlarged view showing a forth modification of the side tube for use in the photomultiplier tube according to the present invention.
Figure 17:
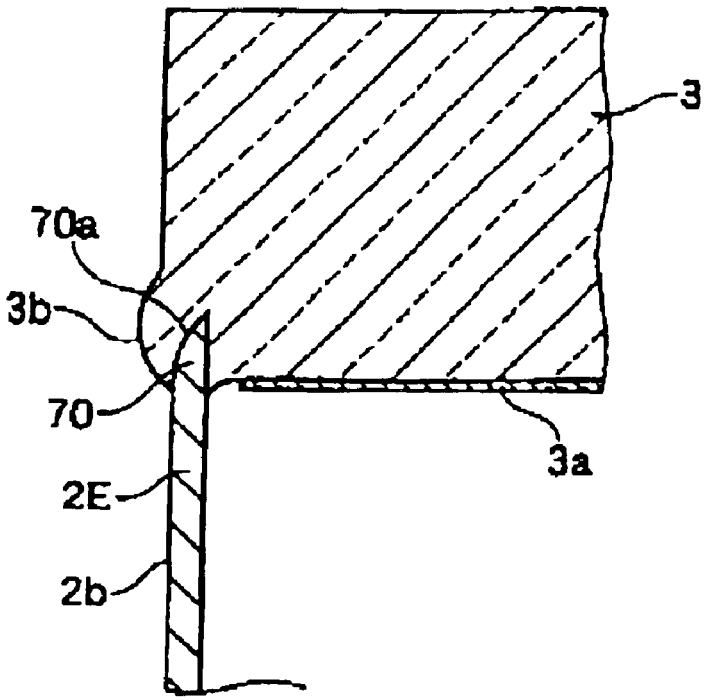
FIG. 17 is an enlarged view showing a fifth modification of the side tube for use in the photomultiplier tube according to the present invention.
Figure 18:
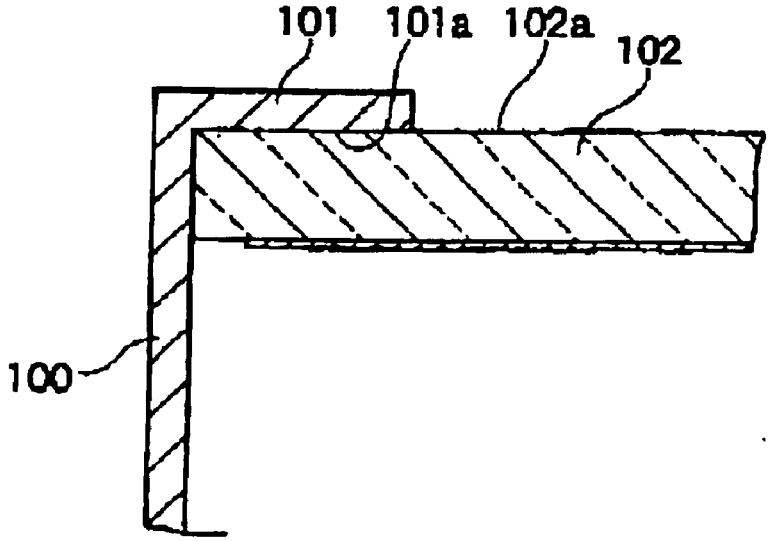
FIG. 18 is an enlarged view showing a conventional side tube for use in a photomultiplier tube.

FIG. 16 shows a forth modification in which an edge portion 60 extends straight along the axial direction of the side tube 2D. The edge portion 60 has a single-edged tip end. In this case, the edge portion 60 has an R-shaped portion 60*a* on an inner side wall 2*c* of the side tube 2D in order to enhance conformability with glass and increase an surface area of the edge portion 60. Similarly, FIG. 17 shows a fifth modification, in which an edge portion 70 extends straight in an axial direction of the side tube 2E. The edge portion 70 has a single-edged tip end. In this case, the edge portion 70 has an R-shaped portion 70*a* on an outer side wall 2*b* of the side tube 2E.

The side tube 2 may have a polygonal section such as a triangle, a rectangle, a hexagon, and an octagon. The shape of the tip may be spherical or have a shape such as a tail of an arrow.

In the above embodiments, the side tube 2 is defined by four rectangular flat plates 80. Each plate 80 has vertical sides and horizontal sides. The adjacent vertical sides of the plates are joined to form the corner 81. The horizontal side has a curved shape in which the center of the horizontal side protrudes toward the open end B facing the stem plate 4 like an arrow. Therefore, at an end face of the open end A of the side tube 2 having the substantially rectangular shape which faces the faceplate 3, the end face 81*a* on the corner 81 protrudes above the end face 80*a* other than the corner 81. As long as a fixed positional relation between the corner and the faceplate 3 at the end face of the open end A of the side tube facing the faceplate 3 is ensured, the shape of the plate is not limited to the described above. For example, the plate may have a projection integrated therewith at one end of a horizontal side of the rectangular plate. Alternatively, the rectangular plate may have at least one of bent horizontal sides.

INDUSTRIAL APPLICABILITY

A photomultiplier tube according to the present invention may be used with an imaging device for a lower luminescent area such as a monitoring camera, and night-vision equipment.

What is claimed is:

1. A photomultiplier tube comprising:

a faceplate;

a photocathode for emitting electrons in response to light incident on the faceplate;

a hermetically sealed vessel;

an electron multiplier in the hermetically sealed vessel for multiplying electrons emitted from the photocathode; and an anode for generating an output signal based on electrons multiplied by the electron multiplier, wherein the hermetically sealed vessel includes:

a stem plate having stem pins for fixing the electron multiplier and the anode thereon;

a metal side tube enclosing the electron multiplier and the anode, and having a first open end to which the stem plate is fixed and a second open end; and the faceplate fixed to the second open end of the side tube, the faceplate being made of glass, and wherein the metal side tube has a hollow prismatic shape defined by a plurality of plates, each of the plurality of plates having a bowed upper end, and the metal side tube is fused and fixed to the faceplate in such a manner that the bowed upper end of each plate is embedded in the faceplate.

2. The photomultiplier tube according to claim 1, wherein an inner side wall at the first open end of the side tube is in contact with an end face of the metal stem plate, and the metal side tube and the metal stem plate are welded together.

3. The photomultiplier tube according to claim 1, wherein the side tube has an edge portion on the bowed upper end of each plate, the edge portion is to be embedded in the faceplate.

4. The photomultiplier tube according to claim 3, wherein a tip end of the edge portion extends straight.

5. The photomultiplier tube according to claim 3, wherein a tip end of the edge portion is curved toward either one of an interior and an exterior of the side tube.

6. The photomultiplier tube according to claim 3, wherein the edge portion has a knife-edged tip end.

7. A photomultiplier tube comprising:

a faceplate;

a photocathode for emitting electrons in response to light incident on the faceplate;

a hermetically sealed vessel;

an electron multiplier in the hermetically sealed vessel for multiplying electrons emitted from the photocathode; and an anode for generating an output signal based on electrons multiplied by the electron multiplier, wherein the hermetically sealed vessel includes:

a stem plate having stem pins for fixing the electron multiplier and the anode thereon;

a metal side tube having first and second open ends and enclosing the electron multiplier and the anode, the stem plate being fixed to the first open end; and the faceplate fused and fixed to the second open end of the side tube, the faceplate being made of glass, and wherein the side tube comprises a hollow prism defined by a plurality of plates, each of the plurality of plates has a pair of vertical sides and a pair of horizontal sides, one of the pair of horizontal sides forms the first open end, a remaining one of the pair of horizontal sides forms the second open end, the side tube having a plurality of corners formed by joining the vertical sides of adjacent ones of the plurality of plates, one end of at least one of the plurality of corners which is connected to the remaining one of the pair of horizontal sides protrudes beyond a midpoint of the remaining one of the pair of horizontal sides towards the faceplate, the faceplate is fused and fixed to the second open end in a manner that the second open end is embedded in the faceplate.

8. The photomultiplier tube according to claim 7, wherein the one of the pair of horizontal sides has a convex configuration of which a central portion protrudes towards the first open end like an arch.

9. The photomultiplier tube according to claim 7, wherein the stem plate is made from metal, an edge face of the stem plate is in contact with an inner side wall adjacent to the first open end of the side tube, the inner side wall and the edge face of the stem plate are welded.

10. The photomultiplier tube according to claim 7, wherein an edge portion is provided on the second open end of the side tube.

11. The photomultiplier tube according to claim 10, wherein a tip end of the edge portion extends linearly from the side tube perpendicularly to the photocathode.

12. The photomultiplier tube according to claim 10, wherein a tip end of the edge portion curves toward either one of an interior and an exterior of the side tube in a direction deviated from a perpendicular to the faceplate.

13. The photomultiplier tube according to claim 10, wherein the edge portion has a knife-edged tip end.

14. A method for manufacturing a photomultiplier tube comprising:

a faceplate;

a photocathode for emitting electrons in response to light incident on the faceplate;

a hermetically sealed vessel;

an electron multiplier in the hermetically sealed vessel for multiplying electrons emitted from the photocathode; and an anode for generating an output signal based on electrons multiplied by the electron multiplier, wherein the hermetically sealed vessel includes a side tube having a hollow prismatic shape having two open ends and a plurality of plates, each of the plurality of plates has a pair of horizontal sides and a pair of vertical sides, one of the pair of horizontal sides is bowed and forms one of the two open ends, the side tube has a plurality of corners formed by joining the vertical sides of adjacent ones of the plurality of plates, the method comprises the steps of:

contacting one upper end of at least one of the plurality of corners crossing he bowed horizontal side to the faceplate; and heating the side tube to fuse and fix the one of the two open ends of the side tube with the faceplate.

15. The method according to claim 14, an edge portion is provided on the one of the two open ends of the side tube, the edge portion is to be embedded into the faceplate.

16. The method according to claim 14, wherein a remaining one of the two open ends of the side tube is placed on a rotating platform to force the faceplate onto the side tube.

17. A method for manufacturing a photomultiplier tube comprising:

a faceplate;

a photocathode for emitting electrons in response to light incident on the faceplate;

a hermetically sealed vessel;

an electron multiplier in the hermetically sealed vessel for multiplying electrons emitted from the photocathode; and an anode for generating an output signal based on electrons multiplied by the electron multiplier, wherein the hermetically sealed vessel includes a side tube having a hollow prismatic shape with an upper open end, a lower open end, and a plurality of plates, each of the plurality of plates has a pair of vertical sides and a pair of horizontal sides, one of the horizontal sides forms the upper open end, and the side tube has a plurality of corners formed by joining the vertical sides of adjacent ones of the plurality of plates, one end of at least one of the plurality of corners connecting to the one of the pair of horizontal sides protrudes beyond a midpoint of the one of the pair of horizontal sides towards the faceplate, the method comprises the steps of:

orientating the side tube upright in a manner that the upper open end is directed upward;

contacting the faceplate with the upper open end; and heating the side tube to melt a part of the faceplate and fuse and fix the faceplate to the upper open end of the side tube while the upper open end of the side tube is embedded into the faceplate.

18. The method according to claim 17, wherein the step of heating further comprises the steps of supporting the faceplate by the one end of each of the plurality of corners of the side tube, then starting melting from a portion of the faceplate supported by the one end to ensure positional relation between the faceplate and the side tube in an early stage during a welding process.

* * * * *